US009163634B2

(12) United States Patent
Picouet

(10) Patent No.: US 9,163,634 B2
(45) Date of Patent: Oct. 20, 2015

(54) APPARATUS AND METHOD FOR ENHANCING COMPRESSOR EFFICIENCY

(71) Applicant: Vilter Manufacturing LLC, Cudahy, WI (US)

(72) Inventor: Jean-Louis Picouet, Waukesha, WI (US)

(73) Assignee: Vilter Manufacturing LLC, Cudahy, WI (US)

( * ) Notice: Subject to any disclaimer, the term of this patent is extended or adjusted under 35 U.S.C. 154(b) by 0 days.

(21) Appl. No.: 14/032,753

(22) Filed: Sep. 20, 2013

(65) Prior Publication Data

US 2014/0083130 A1 Mar. 27, 2014

Related U.S. Application Data

(60) Provisional application No. 61/706,420, filed on Sep. 27, 2012.

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 28/12*** | (2006.01) |
| ***F04C 18/52*** | (2006.01) |
| ***F04C 29/00*** | (2006.01) |
| *F04C 18/16* | (2006.01) |

(52) U.S. Cl.

CPC ..... *F04C 28/12* (2013.01); *F04C 18/52* (2013.01); *F04C 29/0007* (2013.01); *F04C 18/16* (2013.01)

(58) Field of Classification Search

USPC ..... 418/195, 201.1; 417/310, 440

See application file for complete search history.

(56) References Cited

U.S. PATENT DOCUMENTS

| | | | |
|---|---|---|---|
| 4,254,637 | A | 3/1981 | Brauch et al. |
| 4,275,570 | A | 6/1981 | Szymaszek et al. |
| 4,364,714 | A | 12/1982 | Zimmern |
| 4,419,865 | A | 12/1983 | Szymaszek |
| 4,450,856 | A | 5/1984 | Kocher |
| 4,484,596 | A | 11/1984 | Hikade |
| 4,497,181 | A | 2/1985 | Kocher et al. |
| 4,507,064 | A | 3/1985 | Kocher et al. |
| 4,512,550 | A | 4/1985 | Kocher |
| 4,516,994 | A | 5/1985 | Kocher |
| 4,554,799 | A | 11/1985 | Pallanch |

(Continued)

FOREIGN PATENT DOCUMENTS

| | | | | |
|---|---|---|---|---|
| EP | 2634432 | A1 * | 9/2013 | ..... F04C 18/52 |
| WO | 2009114820 | A2 | 9/2009 | |
| WO | WO2012056728 | A1 | 5/2012 | |

OTHER PUBLICATIONS

International Search Report and Written Opinion for PCT/US2013/060898, mailing date Apr. 25, 2014, 12 pages.

*Primary Examiner* — Theresa Trieu

(74) *Attorney, Agent, or Firm* — Whyte Hirschboeck Dudek S.C.

(57) ABSTRACT

Disclosed herein is a single screw gas compressor having a housing including a cylindrical bore, a primary and secondary gate rotors mounted for rotation in the housing, each gate rotor having a plurality of gear teeth, a main rotor rotatably mounted in the bore and having a plurality of grooves and a plurality of threads, wherein each groove meshingly engages at least one of the gear teeth from each gate rotor, a primary economizer port in communication with the cylindrical bore, and a secondary economizer port in communication with the cylindrical bore.

15 Claims, 9 Drawing Sheets

(56) References Cited

U.S. PATENT DOCUMENTS

| | | | | |
|---|---|---|---|---|
| 4,571,951 | A | 2/1986 | Szymaszek | |
| 4,588,359 | A | 5/1986 | Hikade | |
| 4,610,612 | A | 9/1986 | Kocher | |
| 4,610,613 | A | 9/1986 | Szymaszek | |
| 4,634,093 | A | 1/1987 | Schintgen | |
| 4,660,384 | A | 4/1987 | Pallanch | |
| 4,704,069 | A | 11/1987 | Kocher et al. | |
| 4,801,125 | A | 1/1989 | Kocher | |
| 4,856,366 | A | 8/1989 | Nikolaus | |
| 4,865,073 | A | 9/1989 | Kocher | |
| 4,887,514 | A | 12/1989 | Schintgen | |
| 4,906,264 | A | 3/1990 | Szymaszek et al. | |
| 4,923,173 | A | 5/1990 | Szymaszek et al. | |
| 4,945,941 | A | 8/1990 | Kocher | |
| 4,974,422 | A | 12/1990 | Kocher | |
| 5,085,518 | A | 2/1992 | Langouet | |
| 5,181,414 | A | 1/1993 | Baret et al. | |
| 5,183,395 | A | 2/1993 | Langouet | |
| 5,207,568 | A | 5/1993 | Szymaszek | |
| 5,507,151 | A | 4/1996 | Ring et al. | |
| 5,765,392 | A | 6/1998 | Baur | |
| 6,149,408 | A | 11/2000 | Holt | |
| 6,571,576 | B1 * | 6/2003 | Lifson et al. | 62/513 |
| 6,767,524 | B2 | 7/2004 | Zimmern et al. | |
| 6,826,926 | B2 | 12/2004 | Bush et al. | |
| 6,858,067 | B2 | 2/2005 | Burns et al. | |
| 7,011,183 | B2 | 3/2006 | Picouet | |
| 7,156,624 | B2 | 1/2007 | Shoulders | |
| 7,234,310 | B2 | 6/2007 | Flynn et al. | |
| 7,278,832 | B2 * | 10/2007 | Lifson et al. | 418/55.1 |
| 7,836,724 | B2 * | 11/2010 | Gotoh et al. | 62/513 |
| 7,891,955 | B2 | 2/2011 | Picouet | |
| 8,202,060 | B2 | 6/2012 | Picouet | |
| 2004/0037730 | A1 | 2/2004 | Ueno et al. | |
| 2009/0129956 | A1 | 5/2009 | Picouet | |
| 2010/0260637 | A1 | 10/2010 | Murono et al. | |
| 2011/0070117 | A1 | 3/2011 | Miyamura et al. | |
| 2013/0129553 | A1 | 5/2013 | Picouet | |

* cited by examiner

APPARATUS AND METHOD FOR ENHANCING COMPRESSOR EFFICIENCY

CROSS REFERENCE TO RELATED APPLICATION

This application claims the benefit under 35 U.S.C. Section 119(e) of U.S. Provisional Application No. 61/706,420 filed Sep. 27, 2012, the entire teachings and disclosures of which are incorporated herein by reference.

FIELD

The present disclosure relates to a method and apparatus for enhancing compressor efficiency relates to economizers for compressors, particularly including screw compressors.

BACKGROUND

Compressors are used in various compression systems (e.g., refrigeration systems) to compress gas, such as freon, ammonia, natural gas, or the like, which is used to provide cooling capacity. One type of compressor is a single screw gas compressor, which is comprised of three basic components that rotate and complete the work of the compression process. These components include a single cylindrical main screw rotor with helical grooves, and two gate rotors (also known as star or star-shaped rotors), each gate rotor having a plurality of teeth. The rotational axes of the gate rotors are parallel to each other and mutually perpendicular to the axis of the main screw rotor. This type of compressor employs a housing in which the helical grooves of the main rotor mesh with the teeth of the gate rotors on opposite sides of the main rotor to define gas compression chambers. The housing is provided with two gas suction ports (one near each gate rotor) for inputting the gas and two gas discharge ports (one near each gate rotor) for entry and exit of the gas to the gas compression chambers. It is known to provide two dual slide valve assemblies on the housing (one assembly near each gate rotor) with each slide valve assembly comprising a suction valve (also referred to as a "capacity slide valve") and a discharge slide valve (also referred to as a "volume slide valve") for controlling an associated intake channel and an associated discharge channel, respectively. An electric motor imparts rotary motion through a driveshaft to the compressor's main rotor, which in turn rotates the two intermeshed gate rotors, compressing gas in the gas compression chambers. The compressed gas is passed to a condenser which converts the gas into a liquid. The liquid is further passed to an evaporator that converts the liquid into a gas again while providing cooling in the process.

To increase efficiency of a single screw compressor, an economizer, which is common in the industry, may be provided. The economizer function for screw compressors provides an increase in system capacity and efficiency by sub-cooling the liquid from the condenser through a heat exchanger or flash tank before it enters into the evaporator. More particularly, sub-cooling for the liquid is provided by sending high pressure liquid from the condenser into an economizer vessel through an expansion device to an intermediate pressure. The intermediate pressure in the economizer vessel is provided by an economizer port located part way in the compression cycle process of the screw compressor.

When the compressor unloads below about 60% of the full load capacity, the side/economizer port will drop in pressure level, ultimately being fully open to suction. Therefore, the liquid pressure decreases eventually down to suction pressure and no pressure difference will exist to push the liquid from the economizer vessel to the evaporator. Another side effect when the economizer port is fully opened to suction is the suction pressure will rise and the load on the compressor will need to be increased to keep the suction pressure constant.

One known method to maintain a constant economizer side port pressure is to keep the capacity slide position at 100% and run the compressor with a variable frequency drive (VFD), which can be used to unload the compressor by reducing the speed of the compressor instead of utilizing the capacity slide. Although this serves to maintain the desired pressure ratio at the economizer port, various drawbacks arise. For example, the added expense of purchasing the VFD and maintaining it is undesirable. In addition, the need for increased horsepower due to the inherent losses of the VFD can further increase cost by necessitating a larger capacity compressor. Further, the overall efficiency drops at lower speed due to the losses of the sealing effect between the internal bore and the threads of the rotor, which would allow additional gas to bypass from the high pressure side to the suction side of the compressor, and therefore increase operating costs.

Accordingly, it would be desirable to provide a method and apparatus for enhancing compressor efficiency that overcomes one or more of the aforementioned drawbacks.

BRIEF SUMMARY

In at least some embodiments, the method and apparatus for enhancing compressor efficient relates to a single screw gas compressor with a housing including a cylindrical bore; primary and secondary gate rotors mounted for rotation in the housing, each gate rotor having a plurality of gear teeth, a main rotor rotatably mounted in the bore and having a plurality of grooves and a plurality of threads, wherein each groove meshingly engages at least one of the gear teeth from each gate rotor a primary economizer port in communication with the cylindrical bore, and a secondary economizer port in communication with the cylindrical bore.

In at least some embodiments, the method and apparatus for enhancing compressor efficient relates to a cooling system including a compressor having: a housing including a cylindrical bore; a pair of gate rotors mounted for rotation in the housing, each gate rotor having a plurality of gear teeth; a main rotor rotatably mounted in the bore and having a plurality of grooves and a plurality of threads, wherein each groove meshingly engages at least one of the gear teeth from each gate rotor; a primary economizer port in communication with the cylindrical bore; and a secondary economizer port in communication with the cylindrical bore. The cooling system further including an economizer tank in communication with at least one of the primary economizer port and secondary economizer port, wherein the economizer tank provides pressurized refrigerant gas to the grooves via at least one of the primary economizer port and the secondary economizer port.

In at least some embodiments, the method and apparatus for enhancing compressor efficient relates to a method of enhancing compressor efficiency that includes receiving gas at suction ports of a compressor, rotating a main rotor inside a bore of the compressor, wherein the main rotor includes grooves and the bore includes a bore wall, compressing the gas received from the suction ports inside gas compression chambers formed by the grooves and the bore wall, receiving a first portion of gas at a first of the gas compression chambers through a primary economizer port during a high compressor load, and receiving a second portion of gas at a second of the gas compression chambers through a secondary economizer port during low compressor load.

Other embodiments, aspects, features, objectives and advantages of the method and apparatus for enhancing compressor efficiency will be understood and appreciated upon a full reading of the detailed description and the claims that follow.

BRIEF DESCRIPTION OF THE DRAWINGS

Embodiments of the method and apparatus for enhancing compressor efficiency are disclosed with reference to the accompanying drawings and are for illustrative purposes only. The method and apparatus for enhancing compressor efficiency is not limited in its application to the details of construction or the arrangement of the components illustrated in the drawings. The method and apparatus for enhancing compressor efficiency is capable of other embodiments or of being practiced or carried out in other various ways. Like reference numerals are used to indicate like components. In the drawings.

DETAILED DESCRIPTION OF THE PREFERRED EMBODIMENT

Figure 1:
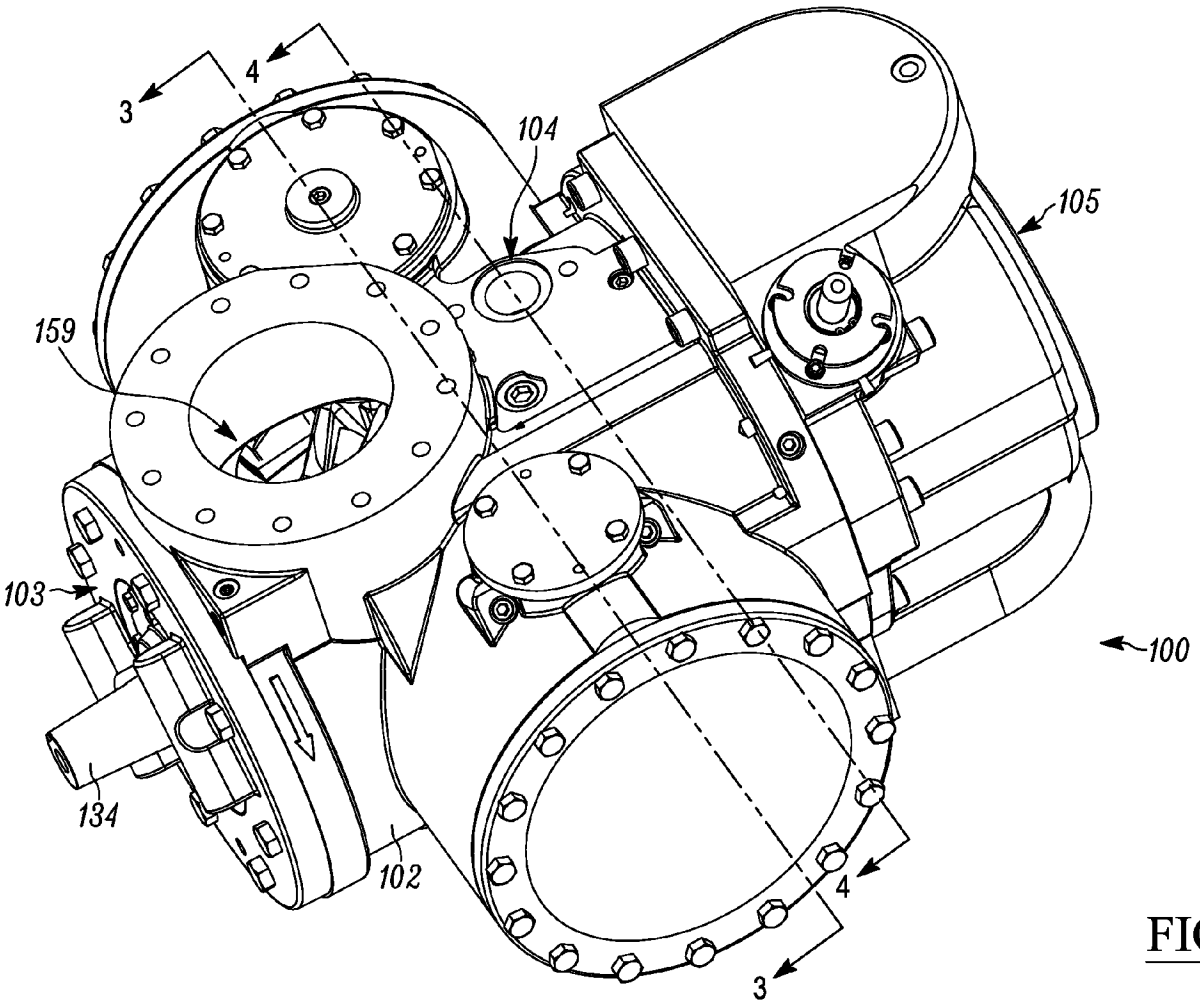
FIG. 1 is a top perspective view of an exemplary compressor.
Figure 2:
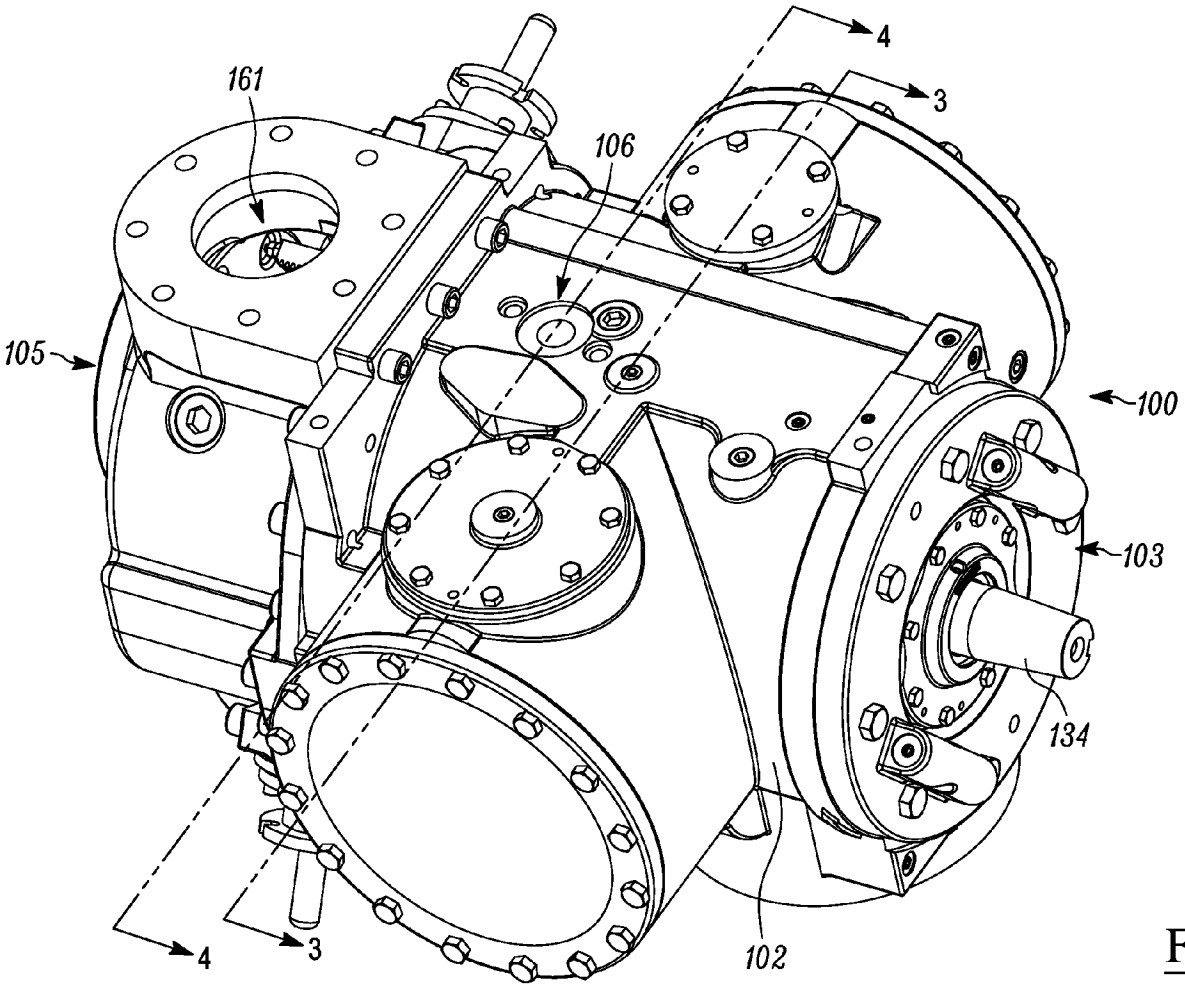
FIG. 2 is a bottom perspective view of the compressor of FIG. 1.

Referring to FIGS. 1 and 2, reference number 100 designates an exemplary compressor 100 used to compress a gas. The compressor 100 is in at least some embodiments, a single screw rotary compressor, although other types of compressors may be suitable as well, such as twin screw or other rotary compressors. FIG. 1 provides a top perspective view of the compressor 100, which includes a compressor housing 102 having a primary economizer port 104. The housing includes a front portion 103 and a back portion 105. In addition, the housing 102 is provided to enclose various compressor components, as discussed below with reference to additional figures. FIG. 2 provides a bottom perspective view of the compressor 100, showing a secondary economizer port 106 formed in the housing 102. As discussed in greater detail below, the primary and secondary economizer ports 104, 106 can be utilized to enhance compressor efficiency during both fully loaded (100% loaded) and unloaded compressor conditions.

Figure 3:
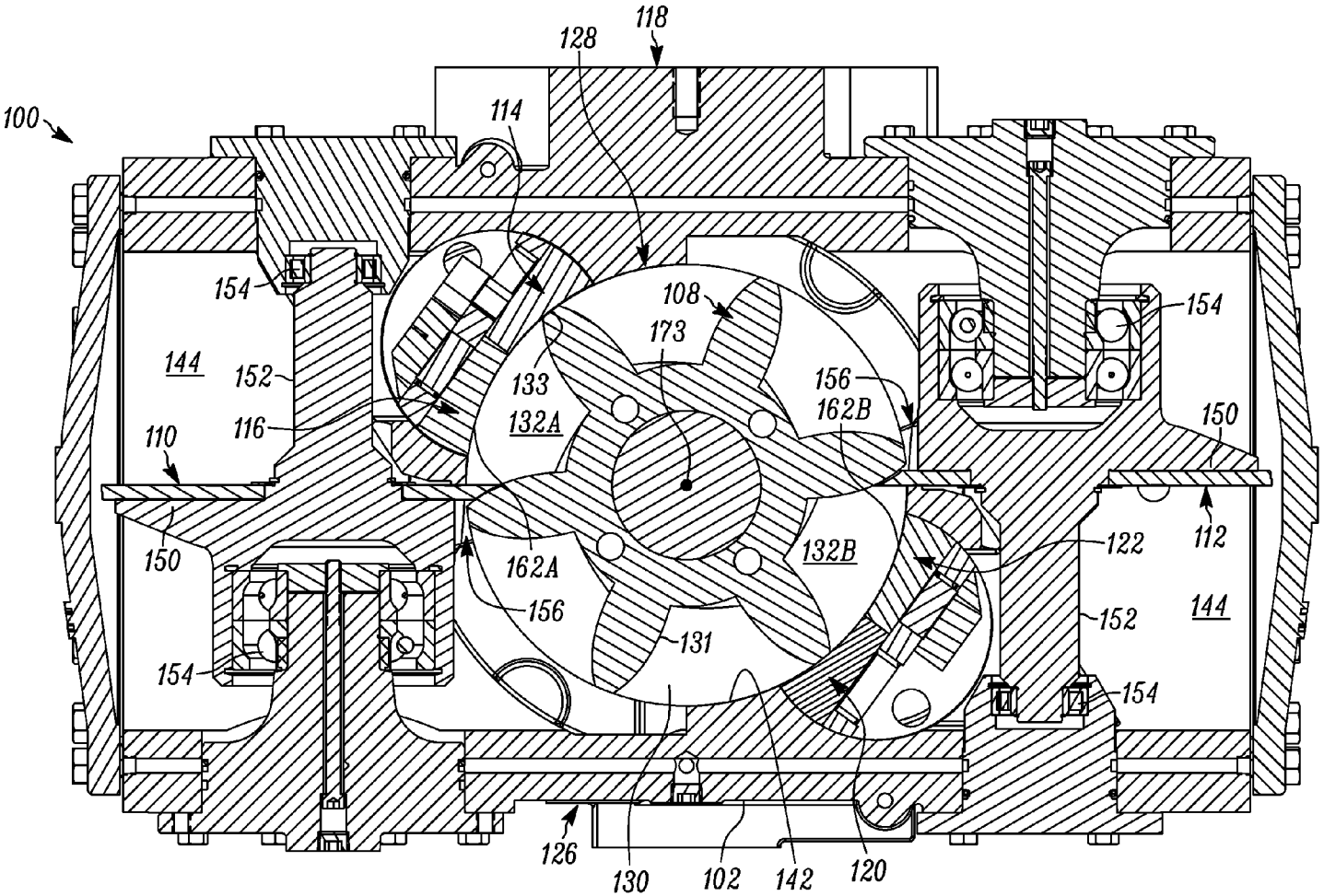
FIG. 3 is a cross-sectional view of the compressor taken along line 3-3 of FIG. 1.
Figure 4:
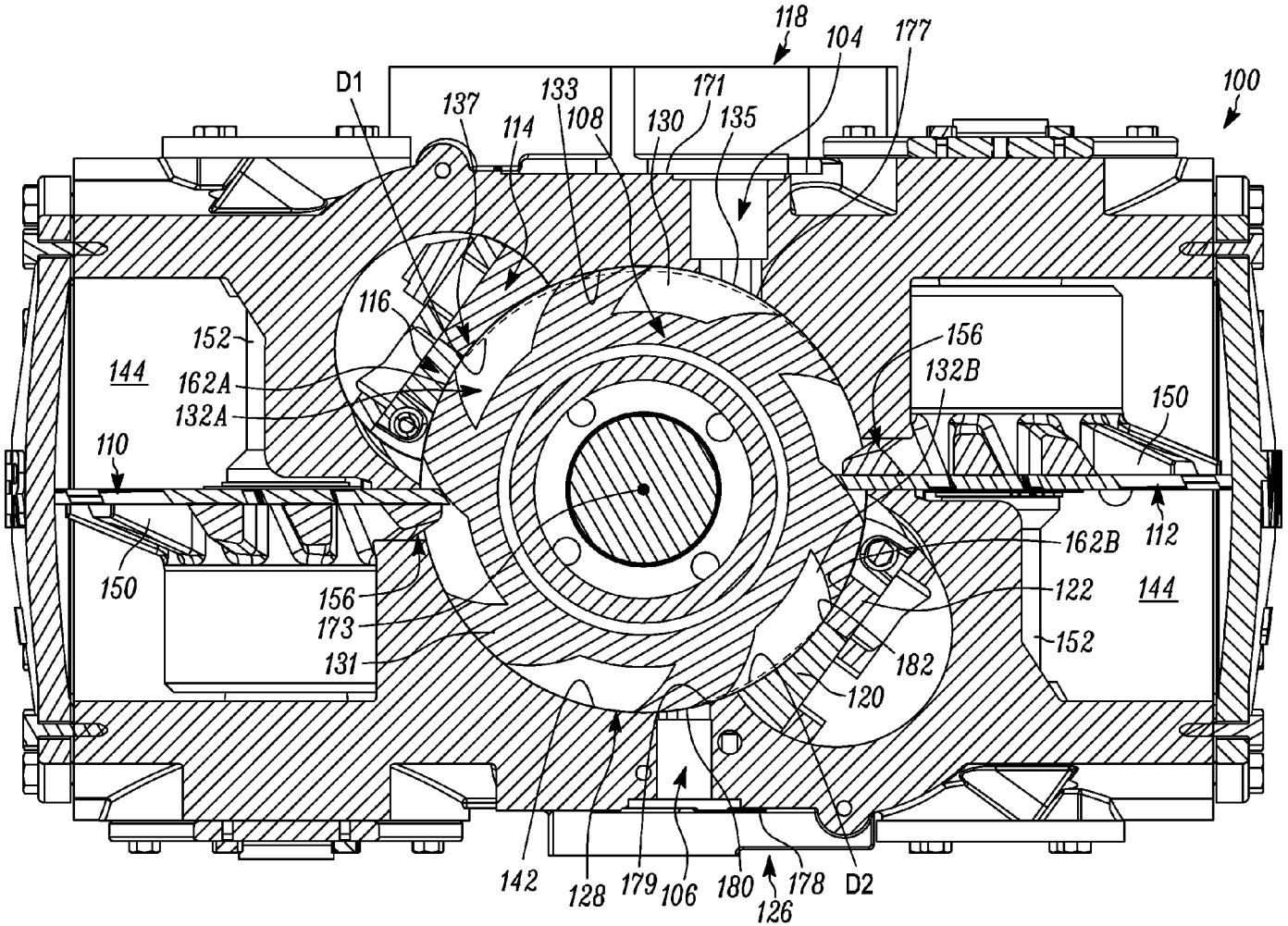
FIG. 4 is a cross-sectional view of the compressor taken along line 4-4 of FIG. 1.

Referring to FIGS. 3 and 4, FIG. 3 provides a cross-sectional back view of the compressor taken at section line 3-3 of FIG. 1. The compressor 100 includes the housing 102, a single main rotor 108 mounted for rotation in the housing 102, and primary and secondary gate rotors (also known as star or star-shaped rotors) 110, 112 mounted for rotation in the housing 102 and engaged with the main rotor 108. Compressor 100 further includes exemplary slide valves, namely a primary capacity slide 114 and a primary volume slide 116 situated closer to a top housing portion 118, and a secondary capacity slide 120 and a secondary volume slide 122 situated closer to a bottom housing portion 126. The slides 114, 116, 120, and 122 are configured to be cooperable with the main rotor 108 to accomplish loading and unloading of the compressor by controlling admission and discharge of gas into and from the gas compression chambers 132A and 132B, in a known manner.

Compressor housing 102 includes a cylindrical bore 128 in which main rotor 108 is rotatably mounted longitudinally therein. Main rotor 108, which is generally cylindrical and has a plurality of helical grooves 130 formed therein (for example, six grooves are illustrated) defining gas compression chambers 132, is provided with a rotor output shaft 134 (FIGS. 1 and 2) which is rotatably supported at opposite ends on bearing assemblies (not shown) mounted on the housing 102. The grooves 130 of the main rotor 108 are formed between helical threads 131 formed on the main rotor 108. Each of the helical threads 131 include a sealing top surface 133 that is rotatable adjacent to a bore wall 142 to provide a seal between the grooves 130.

The housing 102 includes spaces 144 wherein the primary and secondary gate rotors 110, 112 are rotatably mounted and located on opposite sides (i.e., 180 degrees apart) of the main rotor 108. Each of the gate rotors 110, 112 has a plurality of gear teeth 150 and is provided with a respective gate rotor shaft 152 which is rotatably supported at opposite ends on bearing assemblies 154 (FIG. 3) mounted on the housing 102. Each of the gate rotors 110, 112 rotate on a respective axis which is perpendicular to and spaced from the axis of rotation of main rotor 108 and have respective teeth 150 that extend through an opening 156 communicating with bore 128. Each tooth 150 of each of the gate rotors 110, 112 successively is engaged with a groove 130 in the main rotor 108 and, in cooperation with the bore wall 142, these each define a gas compression chamber, such as exemplary gas compression chambers 132A and 132B (FIGS. 3 and 4). The aforementioned engagement allows the rotor output shaft 134 to be driven by a motor (not shown) to drive the main rotor 108 and subsequently the gate rotors 110, 112.

The compressor housing 102 is provided with a main suction port 159 (FIG. 1) and a main discharge port 161 (FIG. 2). In at least some embodiments, during operation of the compressor, gas is drawn in through the suction port 159 and is routed through the compression chambers 132A, 132B for compression therein. Typically, compression of the gas is achieved by rotation of the gate rotors 110, 112 which are synchronized with the main rotor 108, which is driven by the motor (not shown), causing the gear teeth of the gate rotors 110, 112 to intermesh with the helical grooves 130 of the main rotor 108. By virtue of such intermeshing engagement between the gear teeth of the gate rotors 110, 112 and the helical grooves 130 of the main rotor 108, the volume of the gas in the compression chambers 132A, 132B is reduced, thereby achieving compression of the gas. The compressed gas from the compression chamber 132A exits through a primary discharge port opening 162A and is communicated to the main discharge port 161. In addition, the compressed gas from the compression chamber 132B exits through a secondary discharge port opening 162B and is communicated to the main discharge port 161. For reference, the primary discharge port opening 162A includes an opening in the bore wall 142 that is uncovered by the primary volume slide 116 for controlling volume output of the compressor. Similarly, the secondary discharge port opening 162B includes another opening in the bore wall 142 that is uncovered by the secondary volume slide 122 for controlling volume output of the compressor.

Referring still to FIG. 4, the primary economizer port 104 is shown extending as a passage from a housing top surface 171 to the bore 128, adjacent the bore wall 142. The primary economizer port 104 includes a primary base opening 177 situated adjacent the bore wall. The secondary economizer port 106 is shown extending as a passage from a housing bottom surface 178 to the bore 128, adjacent the bore wall 142. The secondary economizer port 106 includes a secondary base opening 179 situated adjacent the bore wall 142. Although not shown in FIG. 4 (see FIG. 9), the primary economizer port 104 and secondary economizer port 106 are in communication with an economizer tank 204 (FIG. 9) via piping, so as to be configured to receive gas from the economizer tank 204 and inject the gas into the compression chambers 132A, 132B as needed.

Figure 5:
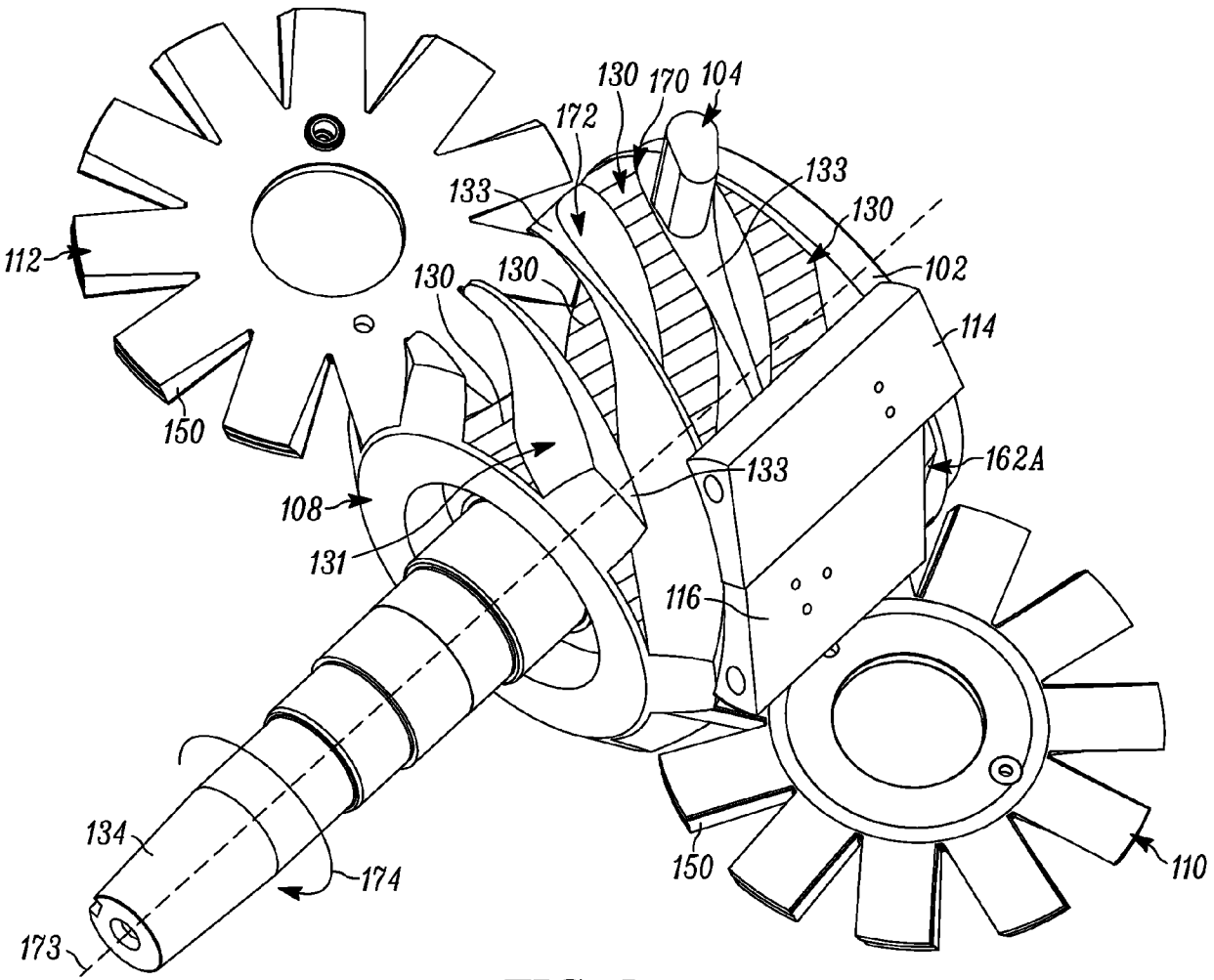
FIG. 5 is a perspective partial view of various components of the compressor including a primary economizer port.

Turning now to FIG. 5, a partial view of various components of the compressor 100 is provided, with the housing 102 removed for clarity. More particularly, the main rotor 108 is shown interfacing with the primary gate rotor 110 and secondary gate rotor 112, with each of the gate rotors again shown to include teeth 150. Further detail is provided of the main rotor 108, including the grooves 130 and the helical threads 131, along with a groove trailing edge 170 and a groove leading edge 172. The primary capacity slide 114 and the primary volume slide 116 are shown along with the primary economizer port 104 and primary discharge port opening 162A. During operation of the compressor, the main rotor 108 rotates clockwise, about a central longitudinal rotor axis 173, as shown by rotational line 174. As identified in FIG. 4 (and also seen in FIG. 6), a primary port center 135 of the primary base opening 177 is situated a rotational distance D1 above a primary top edge 137 of the primary discharge port opening 162A adjacent the bore wall 142 (FIG. 4), thereby providing gas pressure at the primary economizer port 104 consistent with the compression pressure at that position during the compression cycle.

Figure 6:
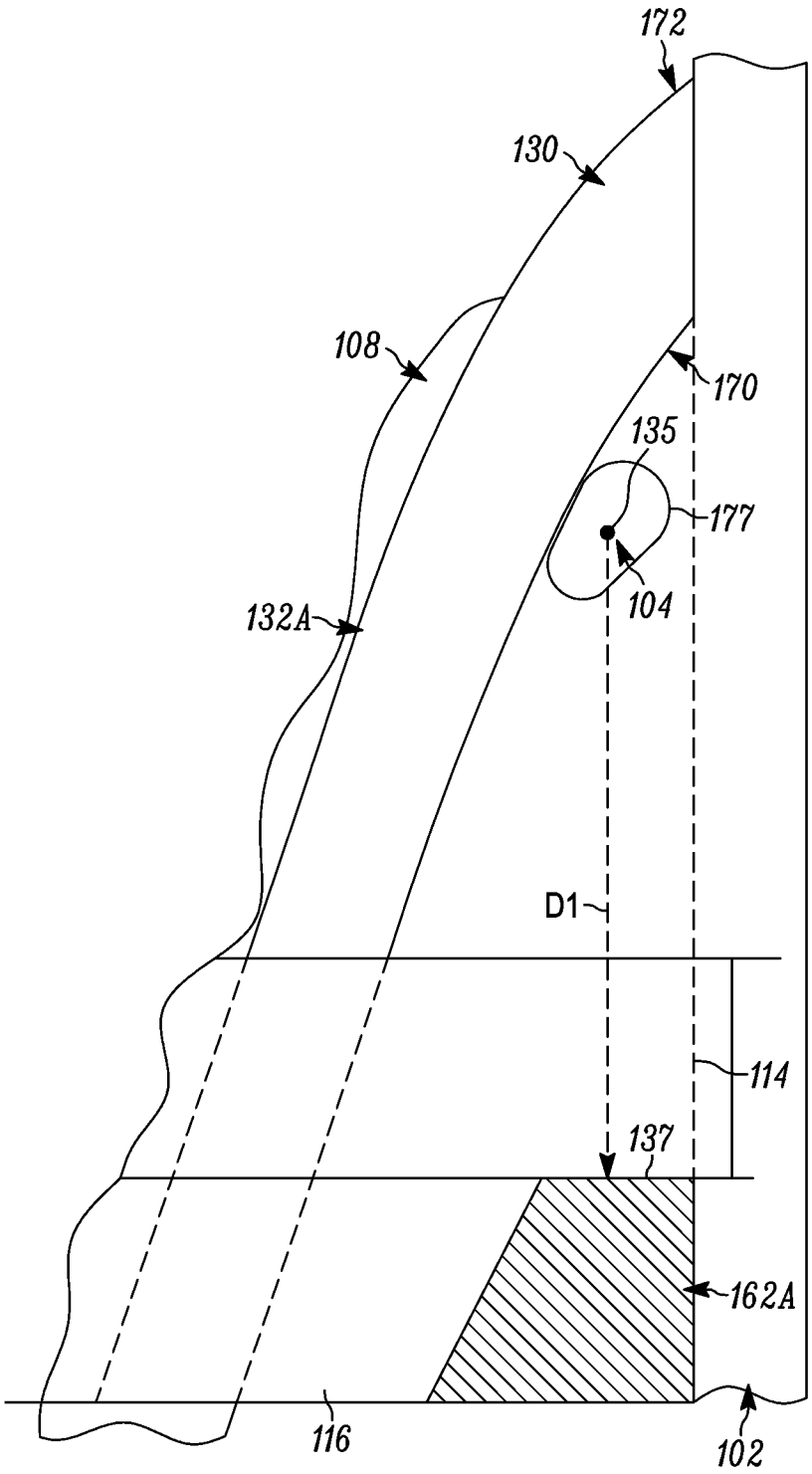
FIG. 6 is a planar projection of a portion of the compressor including a primary economizer port.

With reference to FIG. 6, a planar projection of a portion of the compressor 100 including at least portions of the main rotor 108, the groove 130, the primary economizer port 104, primary discharge port opening 162A, and the slides 114, 116 of FIG. 5 is provided. The groove 130 is shown in a compression-start-position, with the main rotor 108 rotating the groove 130 downward in the direction of D1 as it moves through a compression cycle. As the compression cycle continues, the groove 130 passes under the primary discharge port opening 162A. Eventually the groove 130 passes completely and the sealing top surface 133 (FIG. 5) of the threads 131 (FIG. 5) is positioned under the port to seal the port until the next groove 130 passes thereunder. The size and shape of the primary economizer port 104 is determined by the profile of the main rotor 108 at the location of the primary economizer port 104, wherein the primary economizer port 104 cannot be exposed to more than one groove 130 at a time. Therefore, the primary economizer port 104 is sized to be smaller than the sealing top surface 133 of the threads 131.

Figure 7:
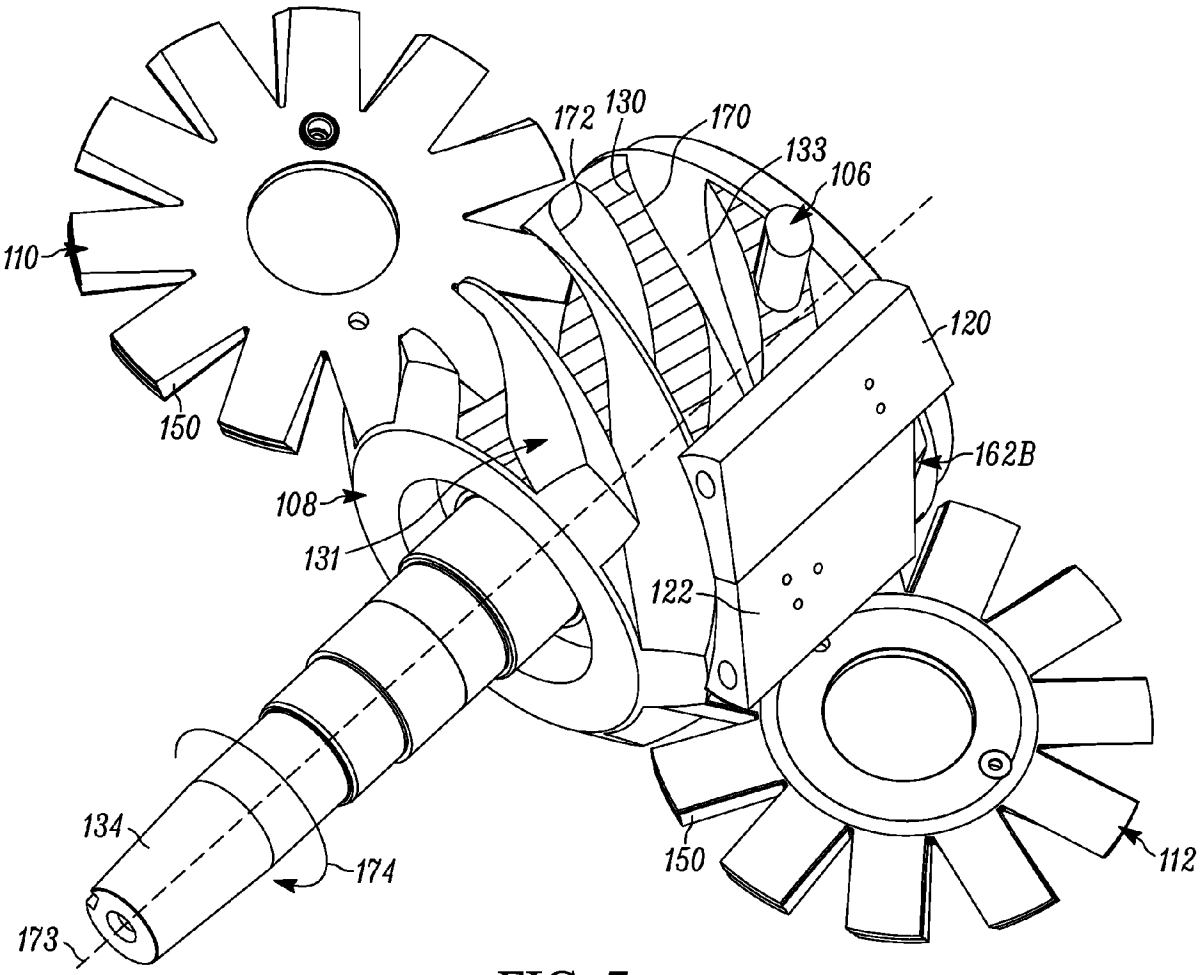
FIG. 7 is a perspective partial view of various components of the compressor including a secondary economizer port.

Referring to FIG. 7, a bottom view of the assembly shown in FIG. 5 (FIG. 5 rotated 180 degrees) is provided that illustrates the positioning of the secondary economizer port 106. As shown, the secondary economizer port 106 is positioned near the secondary capacity slide 120. More particularly, the secondary economizer port 106 is positioned a shorter distance from the secondary discharge port opening 162B than the primary economizer port 104 is from the primary discharge port opening 162A (FIG. 5). As identified in FIG. 4 (and also seen in FIG. 8), a secondary center point 180 of the secondary base opening 179 is positioned a rotational distance D2 below a secondary top edge 182 of the secondary discharge port opening 162B adjacent the bore wall 142 (FIG. 4), thereby providing gas pressure at the secondary economizer port 106 consistent with the compression pressure at that position during the compression cycle. By positioning the secondary economizer port 106 in closer proximity to the secondary discharge port opening 162B, the secondary economizer port 106 is situated further along in the compression cycle and therefore, the gas pressure in the groove 130 will be higher than the gas pressure provided at the primary economizer port 104.

Figure 8:
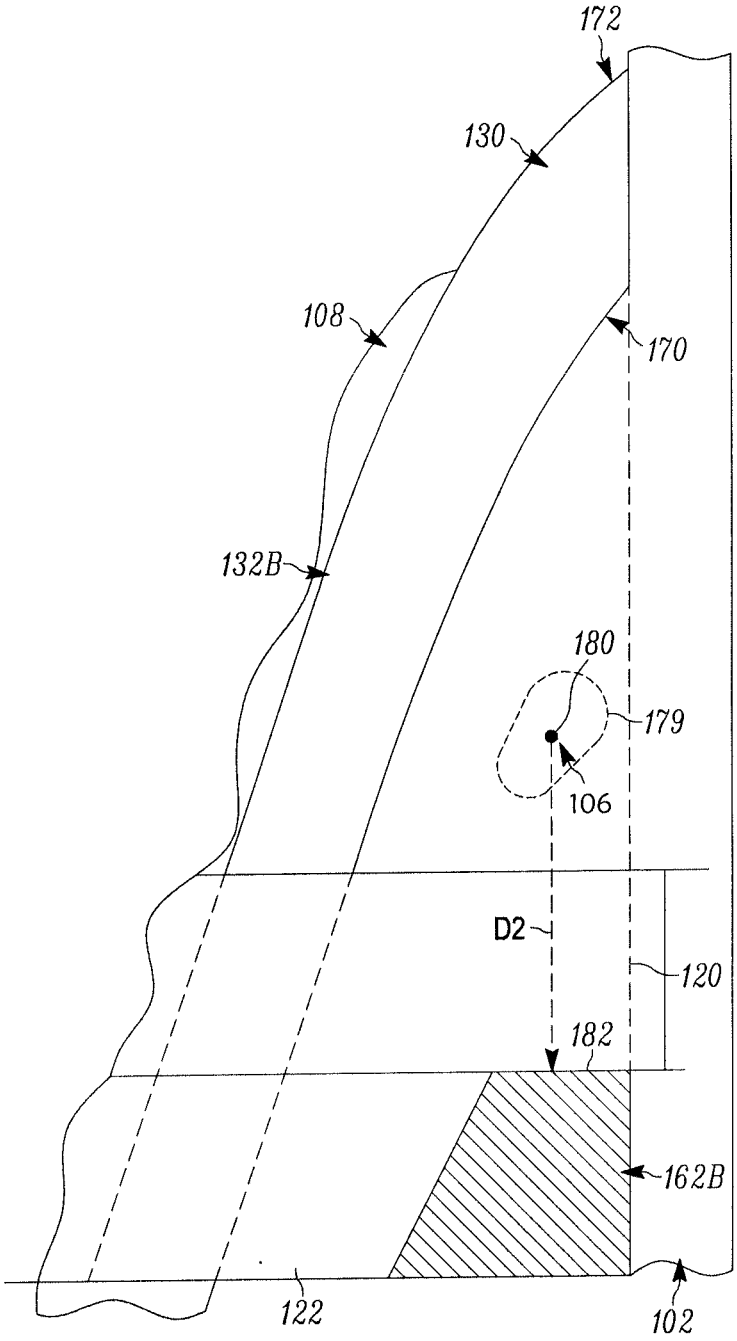
FIG. 8 is a planar projection of a portion of the compressor including a secondary economizer port.

With reference to FIG. 8, a planar projection of a portion of the compressor 100 generally in the region of the cylindrical bore 128 (FIG. 4), including at least portions of the main rotor 108, the groove 130, the secondary economizer port 106, the secondary discharge port opening 162B, and the slides 120, 122, is provided. The groove 130 is shown in a compression-start-position, with the main rotor 108 rotating the groove 130 downward in the direction of D2 as it moves through a compression cycle. As the compression cycle continues, the groove 130 passes under the secondary discharge port opening 162B. Eventually the groove 130 passes completely and the sealing top surface 133 of the threads 131 (FIG. 7) is positioned under the port to seal the port until the next groove 130 passes thereunder. As with the primary economizer port 104, the secondary economizer port 106 can include various shapes and sizes that conform to the main rotor characteristics, as discussed above.

In general compressor operation, when a compressor is unloaded below about 60% of the compressor's full load capacity, the pressure at an economizer port drops to a level where the added efficiency of an economizer ceases to provide sufficient benefit. In the instant case, as the load capacity of the compressor 100 is reduced, via the capacity slides 114, 120 (based on a lower load demand), the gas pressure available at the primary economizer port 104 and the secondary economizer port 106 will be reduced. As the pressure at the primary economizer port 104 is reduced to equal the suction pressure at the primary suction port 159 (FIG. 1), flow of gas at the primary economizer port 104 can be stopped and the flow of gas at the secondary economizer port 106 can be initiated, thereby providing a gas pressure that exceeds the gas pressure available at the primary economizer port 104. This, in turn, allows the compressor to continue using an economizer, such as economizer tank 204 (FIG. 9), to achieve increased efficiency, even when the compressor 100 is substantially unloaded, such as operating at about 10-59% load capacity. Use of the secondary economizer port 104 to achieve the efficiency benefits of an economizer tank 204 in the system 200 are achieved without the use or need for a VFD to control the main rotor speed. It is to be noted that a single screw compressor, such as compressor 100, has two compression sides in one compression cycle, and as such, provides the opportunity to position a primary economizer port 104 on one side and a secondary economizer port 106 on the other side.

The compressor 100 has been discussed above primarily with regard to the compressor function. To provide a more complete system overview, FIG. 9 has been provided, which shows a schematic representation of an exemplary cooling system 200 that includes the compressor 100. The cooling system 200 further includes a condenser 202, the economizer tank 204, and an evaporator 206. The economizer tank 204 is, in at least some embodiments, a flash economizer tank, although other types of economizers may be suitable as well, such as a shell and tube configuration. The evaporator 206 and condenser 202 are also known as heat exchangers, and are available in numerous suitable configurations.

Figure 9:
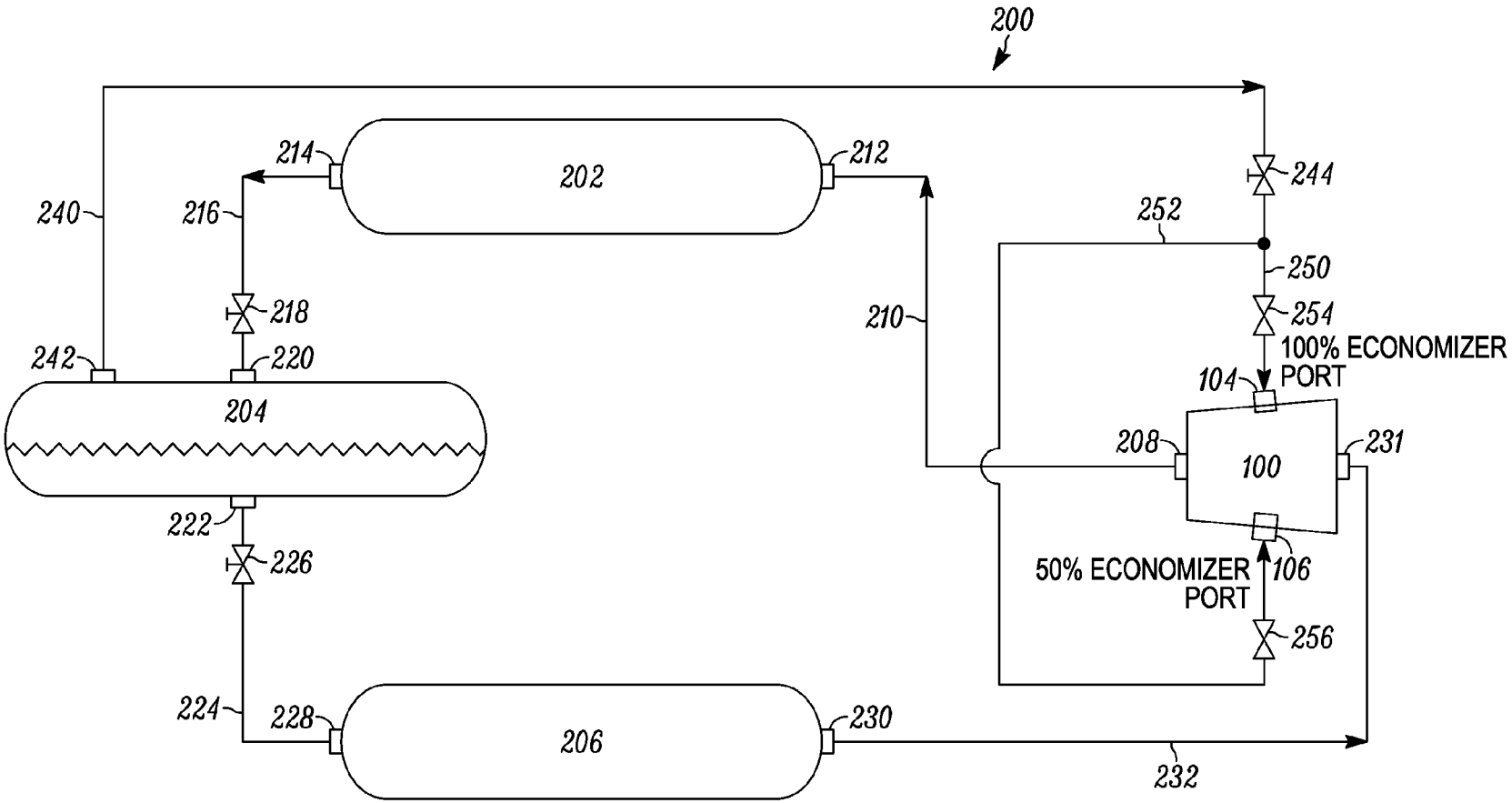
FIG. 9 is a schematic view of an exemplary cooling system.

As seen in FIG. 9, the components of the cooling system 200 are inter-connected to provide a pressurized flow of refrigerant (gas and liquid) therethrough. Refrigerant in the form of a compressed gas is passed from the compressor discharge port 208 through a compressor line 210 to a condenser input port 212. As heat is removed from the refrigerant by the condenser 202, the gas is converted to liquid and discharged from a condenser output port 214. The liquid refrigerant is then passed through a condenser line 216, where the refrigerant is metered through a first expansion valve 218 and into the economizer tank input port 220. The liquid refrigerant is pushed from the economizer tank 204 at an output port 222 and through an evaporator line 224. An intermediate pressure is established in the economizer tank 204 to expel the refrigerant. The evaporator line 224 includes a second expansion valve 226 that releases the refrigerant into the evaporator 206 through an evaporator input port 228. The evaporator 206 provides cooling energy as it converts the liquid refrigerant to a gas, with the gas being outputted through an evaporator output port 230 and an evaporator line 232 into a compressor input port 231.

In addition to the aforementioned inter-connections, the economizer tank 204 further includes an economizer line 240 that passes gas refrigerant from the economizer tank 204 through an economizer output port 242 to a third expansion valve 244, and split into a primary economizer line 250 and secondary economizer line 252. The primary economizer line 250 is connected to the primary economizer port 104 through a primary shut-off valve 254. The secondary economizer line 252 is connected to the secondary economizer port 106 through a secondary shut-off valve 256.

Control of gas flow at the primary economizer port 104 is performed by the primary shut-off valve 254, while gas flow at the secondary economizer port 106 is controlled at the secondary shut-off valve 256. The primary shut-off valve 254 and secondary shut-off valve 256 are configured so that one valve is open while the other is closed, with the primary shut-off valve 254 being in an open position during high compressor load (about 60-100% load) and the secondary shut-off valve 256 being in an open position during low compressor load (about 10-59% load). The desired open/closed positions of these valves 244, 254 can be determined in response to feedback received from various sources, such as pre-determined set-points and limits, as well as active sensors monitoring the compressor 100 (e.g., loading status). Control of the valves 254, 256 can be performed by one or more of various components, using electrical, pneumatic, and/or mechanical methods. The percent of load that is considered to be a high compressor load and low compressor load can vary based on numerous criteria, such as compressor capacity, load conditions, etc., and as such should be considered exemplary ranges as various other ranges can be utilized as well.

During operation of the cooling system 200, under high compressor load conditions, the primary economizer port 104 is opened via the primary shut-off valve 254, thereby providing sufficient intermediate pressure at the economizer tank 204 to sub-cool the liquid in the economizer tank 204. When the load conditions are changed to a low compressor load, the primary shut-off valve 254 is closed and the secondary shut-off valve 256 is opened. The higher pressure available from the secondary economizer port 106 is then available to maintain the intermediate pressure at an acceptable level to sub-cool the liquid and push the liquid refrigerant to the evaporator 206. When the compressor is started under low compressor load conditions, the secondary shut-off valve 256 can be utilized first.

Although the figures are largely representative of a single screw compressor, the apparatus and method for enhancing compressor efficiency can be adapted for use with other compressor types. It is specifically intended that the method and apparatus for enhancing compressor efficiency not be limited to the embodiments and illustrations contained herein, but include modified forms of those embodiments including portions of the embodiments and combinations of elements of different embodiments as come within the scope of the following claims. In addition, the order of various steps of operation described herein can be varied. Further, numerical ranges provided herein are understood to be exemplary and shall include all possible numerical ranges situated therebetween.

I claim:

1. A single screw gas compressor comprising:

a housing including a cylindrical bore;

primary and secondary gate rotors mounted for rotation in the housing, each gate rotor having a plurality of gear teeth;

a main rotor rotatably mounted in the bore and having a plurality of grooves and a plurality of threads, wherein each groove meshingly engages at least one of the gear teeth from each gate rotor;

a primary economizer port in communication with the cylindrical bore;

a secondary economizer port in communication with the cylindrical bore; and a primary discharge port opening and a secondary discharge port opening, wherein the primary economizer port is situated a rotational distance along a bore wall from the primary discharge port opening that exceeds the rotational distance along the bore wall between the secondary economizer port and the secondary discharge port opening;

wherein the secondary economizer port is situated on one of a top housing portion and a bottom housing portion, and the primary economizer port is situated on the other of the top housing portion and bottom housing portion; and wherein the secondary economizer port receives gas from an external source during compressor loading between about 10% to about 59% of full load capacity.

2. The compressor of claim 1 further including a first gas compression chamber created by a portion of the primary gate rotor, a portion of a respective main rotor groove, and the cylindrical bore, and a second gas compression chamber created by a portion of the secondary gate rotor, a portion of a respective main rotor groove, and the cylindrical bore.

3. The compressor of claim 2, wherein gas is received in the first gas compression chamber via the primary economizer port during rotational operation of the main rotor.

4. The compressor of claim 2, wherein gas is received in the second gas compression chamber via the secondary economizer port during rotational operation of the main rotor.

5. The compressor of claim 4, wherein gas in the second gas chamber is discharged via the secondary discharge port opening.

6. The compressor of claim 4 wherein, during operational rotation of the main rotor, the secondary economizer port is exposed to the gas in the second gas compression chamber prior to the discharge of the gas from the second gas compression chamber through the secondary discharge port opening.

7. The compressor of claim 2, wherein during rotational operation of the main rotor, gas is received in the second gas compression chamber via the secondary economizer port or in the first gas compression chamber via the primary economizer port.

8. The compressor of claim 2, wherein the secondary economizer port is configured to receive a higher gas pressure from the second gas compression chamber than the primary economizer port is configured to receive from the first gas compression chamber.

9. The compressor of claim 1, wherein the secondary economizer port is positioned further along in a compression cycle than the primary economizer port, so as to be subjected to a higher gas pressure generated by the operation of the compressor.

10. The compressor of claim 1, wherein the secondary economizer port and primary economizer port are configured to receive gas from an external source sequentially, but not concurrently.

11. The compressor of claim 1, wherein the secondary economizer port and primary economizer port are positioned in an opposing configuration relative to a bore wall of the cylindrical bore.

12. A method of enhancing compressor efficiency in the single screw compressor of claim 1,the method comprising:

receiving gas at suction ports of the compressor;

rotating the a main rotor inside the bore of the compressor, wherein the bore includes a bore wall;

compressing the gas received from the suction ports inside gas compression chambers formed by the grooves and the bore wall;

receiving a first portion of gas at a first of the gas compression chambers through the primary economizer port during a high compressor load; and receiving a second portion of gas at the second of the gas compression chambers through the secondary economizer port during low compressor load.

13. The method of claim 12, wherein a high compressor load condition exists when the compressor is loaded between about 60% and about 100% of full load capacity and a low compressor load exists when the compressor is loaded between about 10% and about 59% of full load capacity.

14. A cooling system comprising:

a compressor having:

a housing including a cylindrical bore;

a pair of gate rotors mounted for rotation in the housing, each gate rotor having a plurality of gear teeth;

a main rotor rotatably mounted in the bore and having a plurality of grooves and a plurality of threads, wherein each groove meshingly engages at least one of the gear teeth from each gate rotor;

a primary economizer port in communication with the cylindrical bore;

a secondary economizer port in communication with the cylindrical bore; and a primary discharge port opening and a secondary discharge port opening: and an economizer tank in communication with at least one of the primary economizer port and secondary economizer port, wherein the economizer tank provides pressurized refrigerant gas to the grooves via at least one of the primary economizer port and the secondary economizer port; and wherein the primary economizer port is situated a rotational distance along a bore wall from the primary discharge port opening that exceeds the rotational distance along the bore wall between the secondary economizer port and the secondary discharge port opening;

wherein the secondary economizer port is situated on one of a top housing portion and a bottom housing portion, and the primary economizer port is situated on the other of the top housing portion and bottom housing portion; and wherein the secondary economizer port receives eas from an external source during compressor loading: between about 10% to about 59% of full load capacity.

15. The cooling system of claim 14, further including a condenser for receiving refrigerant from the compressor and communicating the refrigerant to the economizer tank, and an evaporator for receiving refrigerant from the economizer tank and communicating the refrigerant to the compressor.

* * * * *

UNITED STATES PATENT AND TRADEMARK OFFICE

CERTIFICATE OF CORRECTION

PATENT NO. : 9,163,634 B2
APPLICATION NO. : 14/032753
DATED : October 20, 2015
INVENTOR(S) : Picouet It is certified that error appears in the above-identified patent and that said Letters Patent is hereby corrected as shown below:

In the Claims, Claim 14
Column 10, line 32, replace "eas" with --gas--

Signed and Sealed this
Fifteenth Day of March, 2016

Michelle K. Lee

Michelle K. Lee
*Director of the United States Patent and Trademark Office*